US008438696B2

(12) United States Patent
Charlton

(10) Patent No.: US 8,438,696 B2
(45) Date of Patent: May 14, 2013

(54) SURFACE CLEANER INCLUDING A CLEANING PAD

(75) Inventor: Christopher M. Charlton, Medina, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 0 days.

(21) Appl. No.: 13/398,358

(22) Filed: Feb. 16, 2012

(65) Prior Publication Data

US 2012/0204376 A1 Aug. 16, 2012

Related U.S. Application Data

(60) Provisional application No. 61/443,433, filed on Feb. 16, 2011.

(51) Int. Cl.
*A47L 11/34* (2006.01)

(52) U.S. Cl.
USPC ..... 15/322; 15/403

(58) Field of Classification Search ..... 15/320–322, 15/403; *A47L 7/00, 9/22, 11/00, 11/34, 11/40*
See application file for complete search history.

(56) References Cited

U.S. PATENT DOCUMENTS

| | | | |
|---|---|---|---|
| 2,730,748 | A | 1/1956 | Smyth |
| 4,658,461 | A | 4/1987 | Roe et al. |
| 4,852,210 | A | 8/1989 | Krajicek |
| 4,882,804 | A | 11/1989 | Lucas |
| 5,720,078 | A | 2/1998 | Heintz |
| 5,920,952 | A | 7/1999 | Baldacci |
| 6,601,261 | B1 | 8/2003 | Holt et al. |
| 7,033,965 | B2 | 4/2006 | Takabayashi et al. |
| 7,380,307 | B2 | 6/2008 | Tsai |
| 7,409,745 | B2 | 8/2008 | Dodson et al. |
| 7,530,139 | B2 | 5/2009 | Niemeyer et al. |
| 7,555,814 | B2 | 7/2009 | Lee et al. |
| 7,600,401 | B2 | 10/2009 | Rosenzweig |
| 7,650,667 | B2 | 1/2010 | Rosenzweig et al. |
| 7,669,280 | B2 | 3/2010 | Rosenzweig |
| 7,996,948 | B2 | 8/2011 | Kaminer et al. |
| 7,996,949 | B2 | 8/2011 | Rosenzweig et al. |
| 8,171,592 | B2 | 5/2012 | Tsai |

(Continued)

FOREIGN PATENT DOCUMENTS

| | | |
|---|---|---|
| EP | 1027855 | 8/2000 |
| KR | 20080106745 | 12/2008 |

OTHER PUBLICATIONS

International Search Report and Written Opinion for Application No. PCT/US2012/025427 dated Sep. 19, 2012 (8 pages).

*Primary Examiner* — David Redding
(74) *Attorney, Agent, or Firm* — Michael Best & Friedrich LLP

(57) ABSTRACT

A steam surface cleaner operable to clean a surface, and the steam surface cleaner includes a supply tank configured to retain a cleaning fluid, a base including a dispensing nozzle in fluid communication with the supply tank to dispense the cleaning fluid from the supply tank and onto the surface, a handle configured to move the base along the surface, a heater operable to heat the cleaning fluid to generate steam such that the cleaning fluid dispensed from the dispensing nozzle includes steam, and a cleaning pad coupled to the base for movement with the base and such that the cleaning pad is configured to directly contact the surface. The cleaning pad includes an aperture that allows the cleaning fluid to flow from the dispensing nozzle, through the aperture, and onto the surface.

12 Claims, 6 Drawing Sheets

U.S. PATENT DOCUMENTS

2005/0250404 A1 11/2005 Clarke
2006/0168748 A1 8/2006 Dotterman et al.
2007/0124891 A1 6/2007 Lee et al.
2008/0066789 A1 3/2008 Rosenzweig et al.
2009/0000051 A1 1/2009 Rosenzweig et al.
2009/0113657 A1 5/2009 Haan
2009/0223540 A1 9/2009 Rosenzweig et al.
2010/0024146 A1 2/2010 Rosenzweig et al.
2010/0147329 A1 6/2010 Leymonerie
2010/0236018 A1 9/2010 Vrdoljak et al.
2010/0251505 A1 10/2010 Vrdoljak et al.
2010/0269282 A1 10/2010 Kaminer et al.
2010/0287716 A1 11/2010 Kasper et al.

SURFACE CLEANER INCLUDING A CLEANING PAD

CROSS REFERENCE TO RELATED APPLICATIONS

This application claims priority to U.S. Provisional Patent Application No. 61/443,433, filed Feb. 16, 2011, the entire contents of which are hereby incorporated by reference herein.

BACKGROUND

The present invention relates to steam surface cleaners, and more particularly a cleaning pad for a steam surface cleaner.

Surface cleaners, such as steam mops, typically include a supply tank including a first chamber and a second chamber. The first chamber can be used to retain water, and the second chamber can be used to retain a concentrated cleaning solution. The steam mop typically includes an electric heater that is operable to heat the water to produced steam, which is dispensed from the steam mop and onto a surfaced to be cleaned through a nozzle of the steam mop. The steam mop may also includes a scrubbing pad or the like that is moved along the surface by the user to facilitate removing dirt and debris from the surface.

SUMMARY

In one embodiment the invention provides a steam surface cleaner operable to clean a surface, and the surface cleaner includes a supply tank configured to retain a cleaning fluid, a base including a dispensing nozzle in fluid communication with the supply tank to dispense the cleaning fluid from the supply tank and onto the surface, a handle configured to move the base along the surface, a heater operable to heat the cleaning fluid to generate steam such that the cleaning fluid dispensed from the dispensing nozzle includes steam, and a cleaning pad coupled to the base for movement with the base and such that the cleaning pad is configured to directly contact the surface. The cleaning pad includes an aperture that allows the cleaning fluid to flow from the dispensing nozzle, through the aperture, and onto the surface.

In another embodiment the invention provides a cleaning pad configured for use with a steam surface cleaner. The cleaning pad includes a first layer including a first material, the first layer configured to removably couple the cleaning pad to the surface cleaner, and a second layer coupled to the first layer, and the second layer including a second material different than the first material. The cleaning pad further includes an outer perimeter, and an aperture that extends through the first layer within the outer perimeter.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
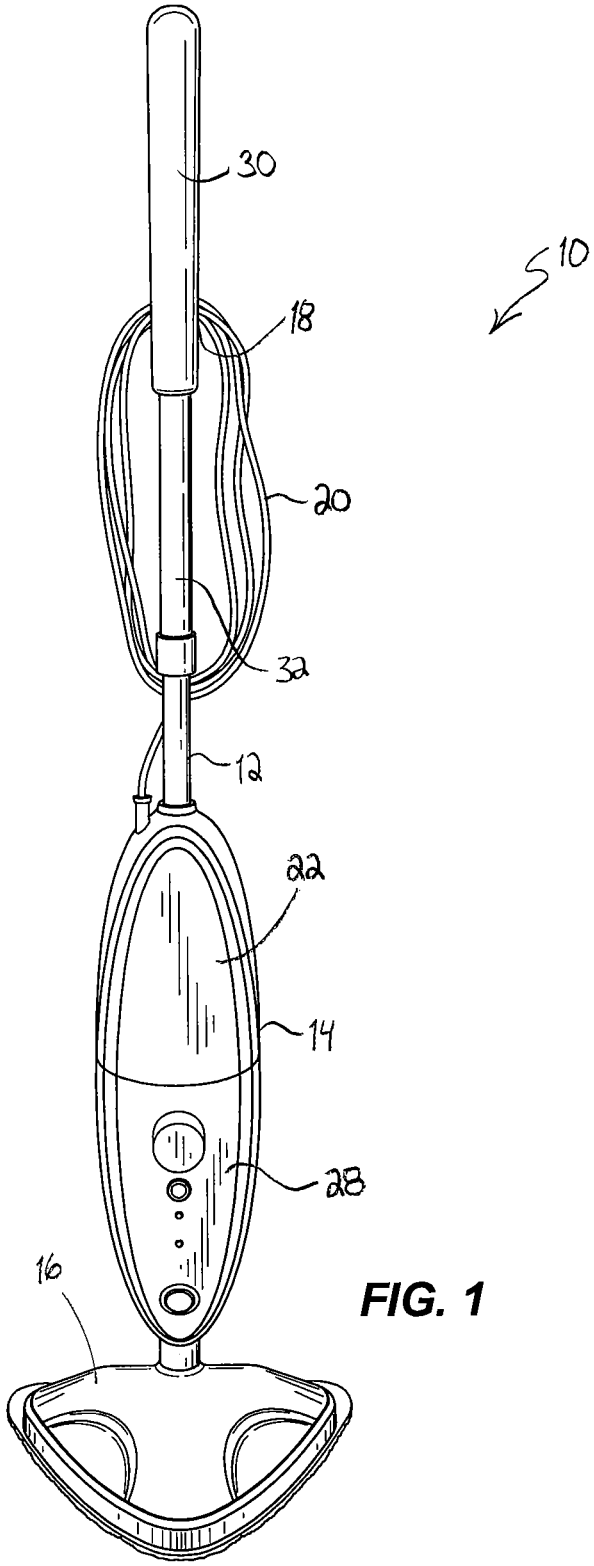
FIG. 1 is a perspective view of a steam surface cleaner according to one embodiment of the invention.

FIG. 1 illustrates an upright surface cleaner 10, which is a steam mop or steam surface cleaner in the illustrated embodiment. The illustrated surface cleaner 10 includes a handle 12, a housing 14, and a foot or base 16 pivotally coupled to the handle 12 and the housing 14. The handle 12 is connected to the housing 14 such that the handle 12 and the housing 14 together pivot with respect to the foot 16. A cord wrap 18 is mounted on the handle 12. An electrical cord 20 for supplying power to the surface cleaner 10 is wrapped around the cord wrap 18 for storage purposes.

Figure 2:
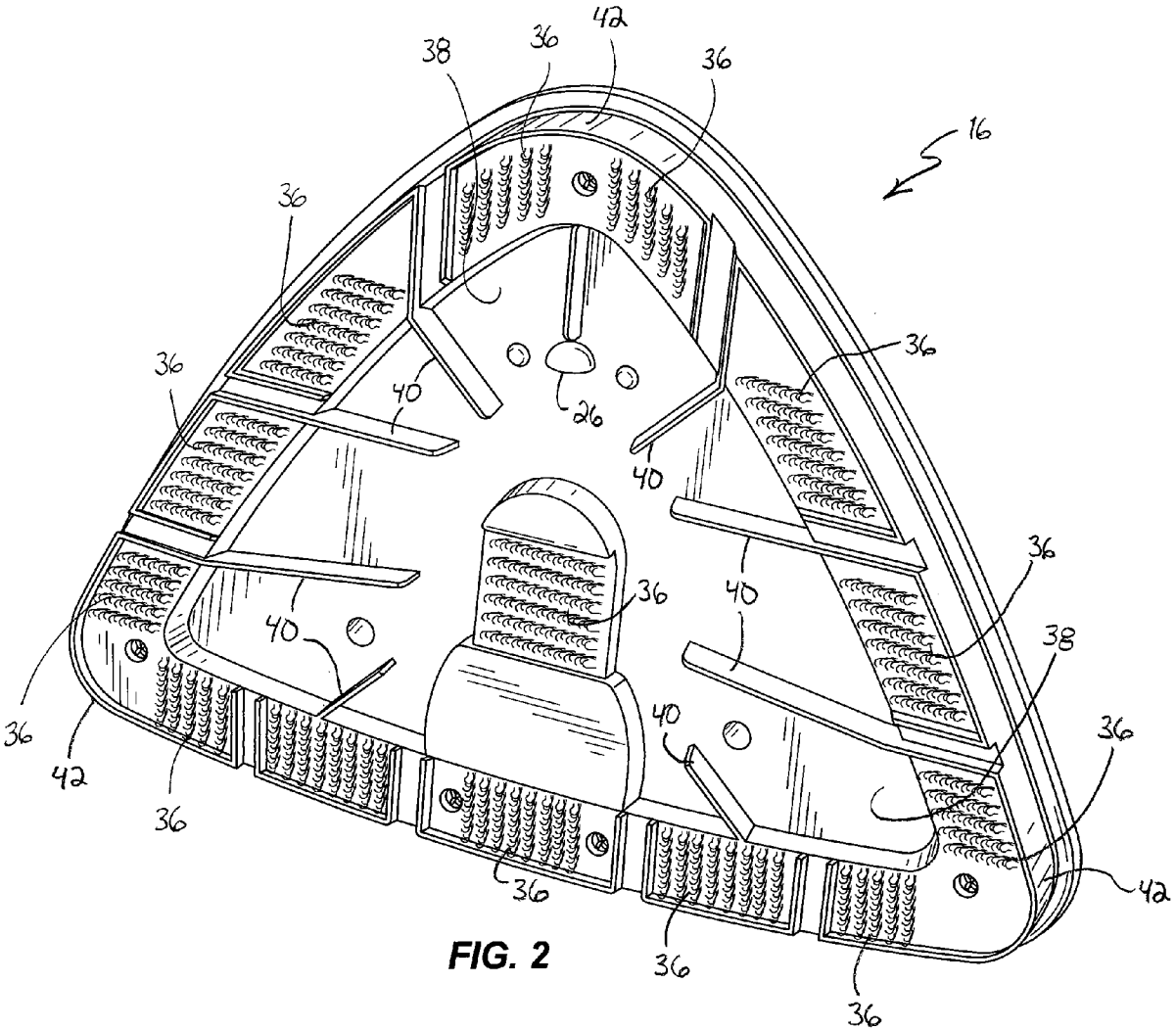
FIG. 2 is a bottom side view of a base of the steam surface cleaner of FIG. 1.

The housing 14 includes a supply tank 22 for holding a cleaning fluid. The cleaning fluid can include water, a concentrated cleaning solution, or a mixture of water and concentrated cleaning solution. In some embodiments, the supply tank 22 includes multiple chambers such that the water and the cleaning solution are held in separate chambers and mixed downstream from the supply tank 22. In one such embodiment, the supply tank 22 includes a first tank on a front side of the cleaner 10 for the water and a second tank, separate from the first tank, on a back side of the cleaner 10 for the concentrated cleaning solution. A supply conduit fluidly connects the supply tank 22 to a downstream solution valve and the supply conduit extends to a dispensing nozzle 26 (FIG. 2). In some embodiments, a pump is in fluid communication with the supply conduit to pressurize the cleaning fluid.

The illustrated surface cleaner 10 further includes a heater 28, which is an electric heater 28 in the illustrated embodiment. The heater 28 is operable to heat the cleaning fluid to vaporize the cleaning fluid that can be discharged from the nozzle 26. The illustrated handle 12 includes a grip portion 30 and an elongated connecting portion 32. The elongated connecting portion 32 connects the grip portion 30 to the housing 14. In some embodiments, a trigger or the like is positioned adjacent the grip portion 30 to control the discharge of the cleaning fluid from the dispensing nozzle 26.

As shown in FIG. 2, the foot 16 includes the dispensing nozzle 26, fasteners 36, a planar wall 38, a plurality of ribs 40 that extend from the wall 38 and normal to the wall 38, and an outer wall 42 that is normal to the planar wall 38 and defines an outer perimeter of the foot 16. Although the illustrated foot 16 includes only a single dispensing nozzle 26, in other embodiments, the foot may include more than one dispensing nozzle 26. For example, in one embodiment, the foot may include a first dispensing nozzle that dispenses steam formed from clean water held in a first chamber of the supply tank 22 and a second dispensing nozzle that dispenses concentrated cleaning solution held in a second chamber of the supply tank 22. As discussed above, in one embodiment, the first chamber can be formed from a first tank on the front side of the cleaner 10 and the second chamber can be formed from a second tank, separate from the first tank, on the back side of the cleaner 10.

Figure 3:
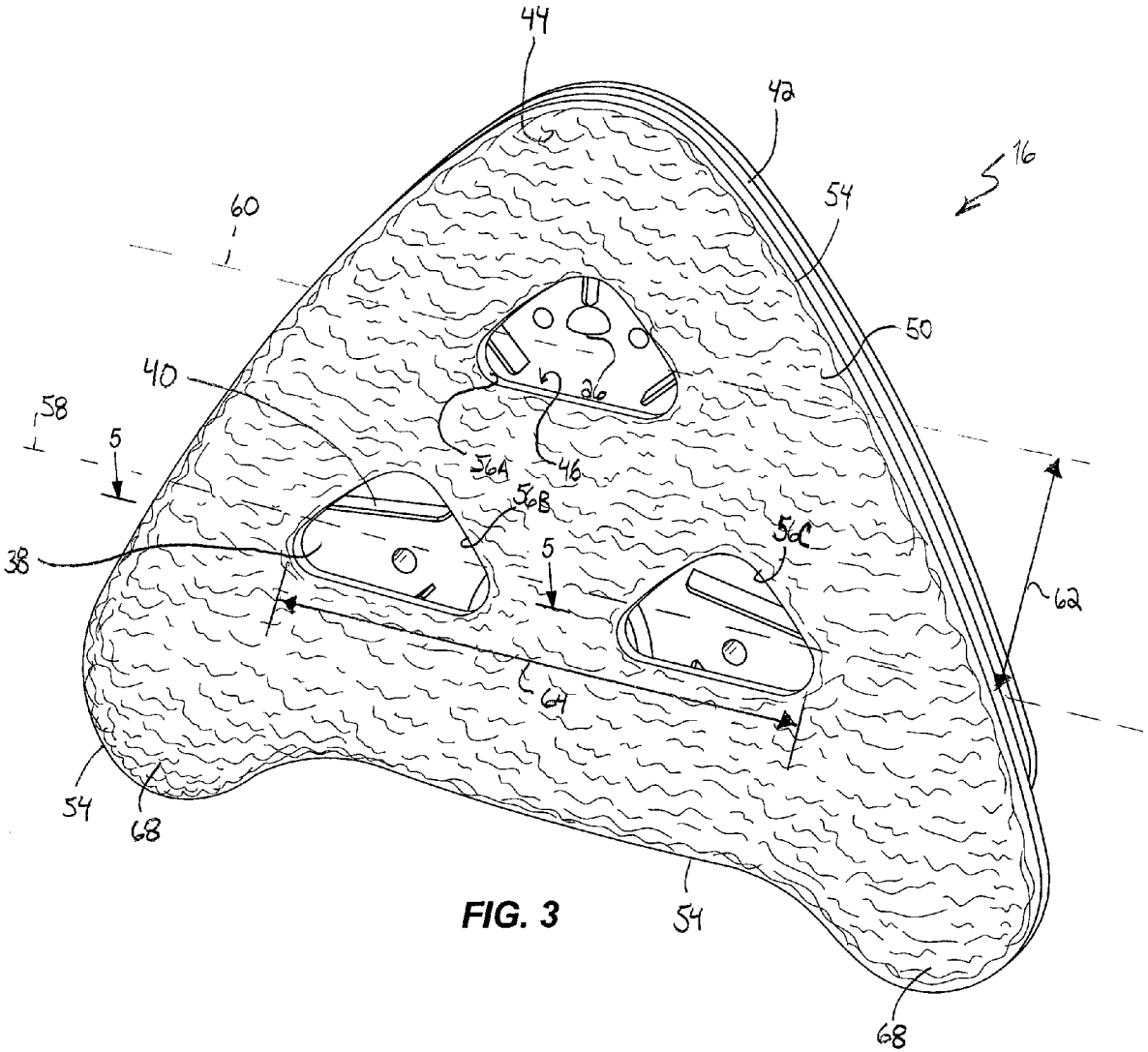
FIG. 3 is a bottom side view of the base of FIG. 1 including a cleaning pad.
Figure 4:
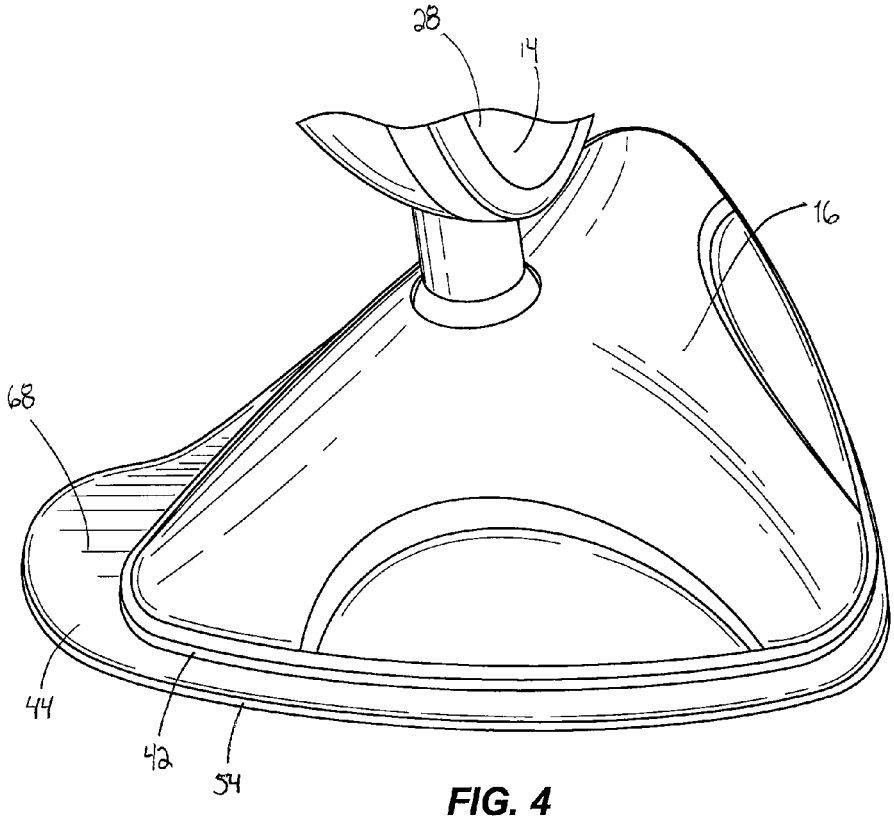
FIG. 4 is a top perspective view of the cleaning pad coupled to the base of the steam surface cleaner of FIG. 1.

Referring to FIGS. 3 and 4, the surface cleaner 10 further includes a cleaning pad 44 that is removably coupled to the foot 16. When the cleaning pad 44 is attached to the foot 16, a plenum chamber 46 is formed between the cleaning pad 44 and the foot 16. The ribs 40 support the cleaning pad 44 to hold the cleaning pad 44 away from the wall 38 of the foot 16 to define the chamber 46. Also, the ribs 40 guide the cleaning fluid discharged from the nozzle 26 to distribute the cleaning fluid, which may be a vapor, evenly across the surface area of the attached cleaning pad 44.

Figure 5:
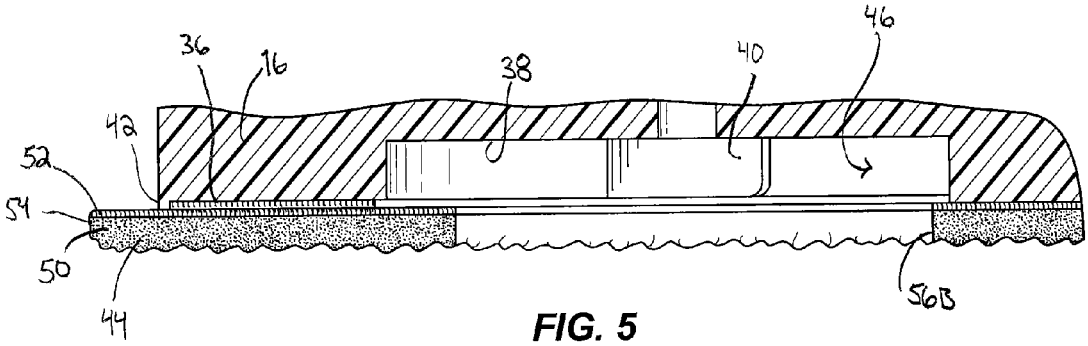
FIG. 5 is a cross-sectional view of the cleaning pad and the base of the steam surface cleaner of FIG. 1 taken along line 5-5 of FIG. 3.

Referring to FIG. 5, the pad 44 includes a first layer 50 and a second layer 52 that are both generally planar fabric layers and the pad 44 defines an outer perimeter 54 that is defined by ends of the layers 50 and 52. The first layer 50 includes a first material made of pile or any other fabric suitable for cleaning surfaces, such as a micro-fiber cloth. The second layer 52, which is a backing layer, includes a second material different than the first material of the first layer 50. In the illustrated embodiment, the second layer 52 includes a loop portion of a hook and loop fastener system that removably attaches the pad 44 to the fasteners 36 of the foot 16, which include the hook portion of the hook and loop fastener system. In another embodiment, the pad 44 includes a plastic or composite material and is not made of fabric.

Referring to FIGS. 3 and 5, the pad 44 includes apertures 56A, 56B, and 56C that extend through the first layer 50 and the second layer 52 within the outer perimeter 54 of the pad 44. When the cleaning fluid is dispensed out of the nozzle 26, a portion of the cleaning fluid flows into the plenum 46 and then through the apertures 56A, 56B, and 56C and onto the surface being cleaned. Therefore, the apertures 56A, 56B, and 56C allow a portion of the cleaning fluid to flow directly onto the surface and a portion of the cleaning fluid that does not flow through the apertures 56A, 56B, and 56C to be absorbed by the pad 44 and eventually permeate through the pad 44.

The aperture 56A is located on the pad 44 such that when the pad 44 is attached to the foot 16, the aperture 56A directly aligns over and exposes the nozzle 26. Although the illustrated pad 44 includes the aperture 56A that directly aligns over and exposes the nozzle 26, in other embodiments, the pad may not include such an aperture 56A and may include only the apertures 56B and 56C that do not directly align over and expose the nozzle 26, but are offset from the nozzle 26. Furthermore, although the illustrated pad 44 includes three apertures 56A, 56B, and 56C, in other embodiments, the pad may include more or less than three apertures.

The illustrated apertures 56A, 56B, and 56C are generally triangular shaped. Also, the illustrated apertures 56B and 56C are located along a first row 58 and the aperture 56A is disposed along a second row 60 that is offset a distance 62, as illustrated in FIG. 3, from the first row 58. Also, the apertures 56A, 56B, and 56C are disposed along the rows 58 and 60 so that the apertures 56A, 56B, and 56C overlap along a distance 64 measured along the rows 58 and 60 as shown in FIG. 3. In other words, the apertures 56B and 56C in the first row 58 are disposed beneath and to the side of the aperture 56A in the second row 60 but yet overlap ends of the aperture 56A. Accordingly, cleaning solution is directly applied to the surface along the entire distance 64 through the apertures 56A, 56B, and 56C when the pad 44 is moved back and forth on the surface to be cleaned. In other embodiments, the apertures 56A, 56B, and 56C can have other suitable shapes, sizes, and positions on the pad.

Referring to FIG. 4, the pad 44 is sized such that the outer perimeter 54 of the pad 44 extends past the outer perimeter of the foot 16 defined by the wall 42 to form tabs 68 of the pad 44. A user can place their foot on one of the tabs 68 and pull the foot 16 away from the pad 44 to remove the pad 44 from the foot 16.

In an alternative embodiment, a plurality of dispensing nozzles 26 are included on the foot 16. A water tank conduit and solution conduit both fluidly connect to the plenum chamber located within the foot 16. The plurality of outlet nozzles 26 are each fluidly connected to the plenum chamber and as a mixture of steam and solution collects in the plenum chamber, gravity and the pressure from the steam flow cause the mixture to be dispensed to each of the nozzles 26. Alternatively, no plenum chamber is included, and the nozzles 26 are each fluidly connected to a separate water tank conduit and a separate solution conduit. Each of the apertures 56A, 56B, and 56C are positioned on the pad 44 to directly align over and expose each of the plurality of the nozzles 26 when the pad 44 is attached to the foot 16. In operation, when a trigger is activated, a mixture of steam and solution is dispensed out each of the nozzles 26 and directly contacts the surface to be cleaned at multiple points, rather than one point. In an alternative embodiment, each of the apertures 56A, 56B, and 56C are positioned on the pad 44 to be offset from all or some of the corresponding nozzles 26, such that the apertures 56A, 56B, and 56C do not align over or expose the nozzles 26 when the pad 44 is attached to foot 16.

In another embodiment, a plurality of perimeter outlet nozzles are included proximate the perimeter of the foot 16 defines by the wall 42. The perimeter outlet nozzles may be fluidly connected to a water tank conduit and a solution conduit. In this embodiment, the pad is sized to be generally smaller than the foot 16 such that the edges of pad do not extend to the perimeter of the foot 16 and no part of the pad covers the perimeter outlet ports. Thus, the mixture of steam and solution dispensed from each perimeter outlet port contacts the surface to be cleaned directly and proximate to the perimeter of the foot 16. In this embodiment, the pad optionally may not include any apertures 56A, 56B, and 56C.

Figure 6:
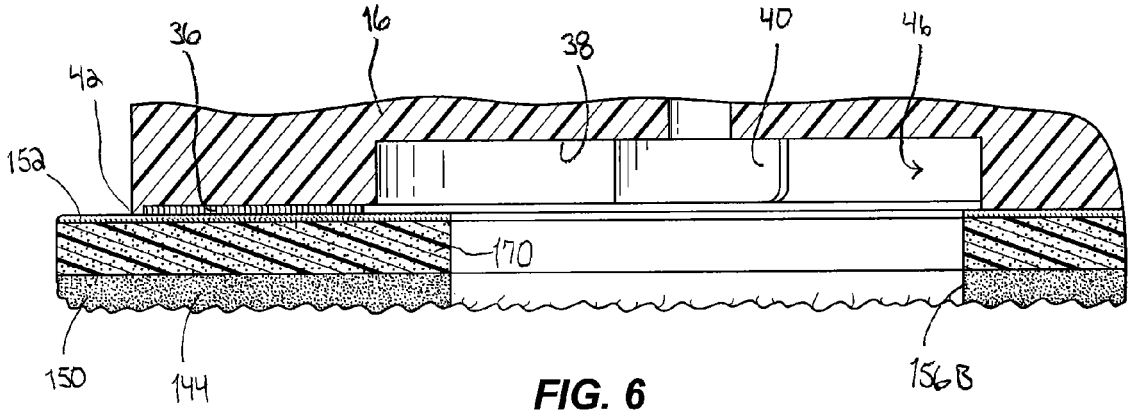
FIG. 6 is a cross-sectional view of the base of the surface cleaner of FIG. 1 similar to the cross-sectional view of FIG. 5, but including a cleaning pad accordingly to another embodiment of the invention.

FIG. 6 illustrates a cleaning pad 144 according to another embodiment for use with the foot 16, and the cleaning pad 144 includes features similar to the cleaning pad 44 of FIG. 1-5 and therefore only differences between the cleaning pads 144 and 44 will be discussed. Also, like components have been given like reference numbers, plus 100. The cleaning pad 144 includes a third layer 170 located between the first layer 150 and the second layer 152. In the illustrated embodiment, the third layer 170 is formed from an absorbent material, such as foam, which provides the pad 144 with the ability to absorb and retain a greater quantity of the cleaning fluid. In other embodiments, the third layer 170 can be formed from other suitable materials. In the illustrated embodiment, the apertures 156A, 156B, and 156C extend through the third layer 170.

Figure 7:
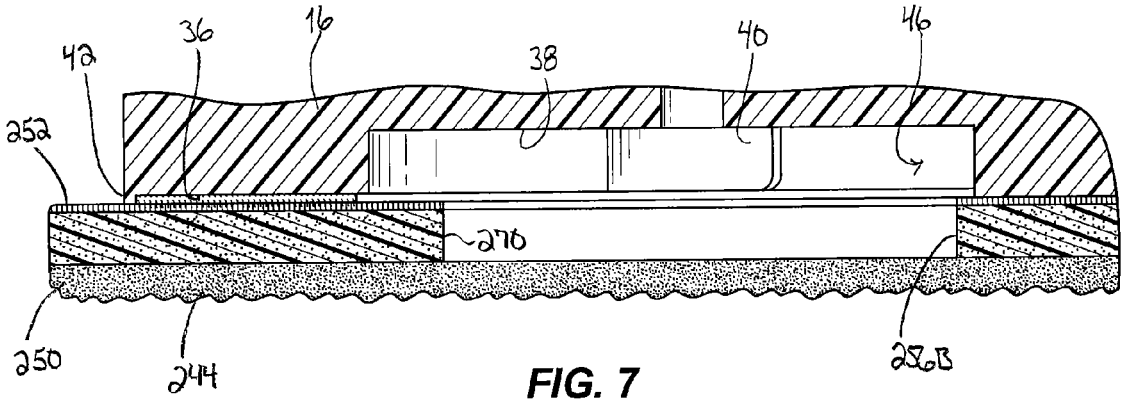
FIG. 7 is a cross-sectional view of the base of the steam surface cleaner of FIG. 1 similar to the cross-sectional view of FIG. 5, but including a cleaning pad accordingly to another embodiment of the invention.

FIG. 7 illustrates a cleaning pad 244 according to another embodiment for use with the foot 16, and the cleaning pad 244 includes features similar to the cleaning pads 44 and 144 of FIGS. 1-6 and therefore only differences between the cleaning pads 44 and 144 will be discussed. Also, like components have been given like reference numbers in the 200 series. The cleaning pad 244 is formed such that the apertures 256A, 256B, and 256C extend only through the second layer 252 and the third layer 270 and the apertures 256A, 256B, and 256C do not extend through the first layer 250. In one embodiment, the second layer 252 is formed from a micro-fiber cloth, which allows the cleaning fluid to permeate through the second layer 252.

Figure 8:
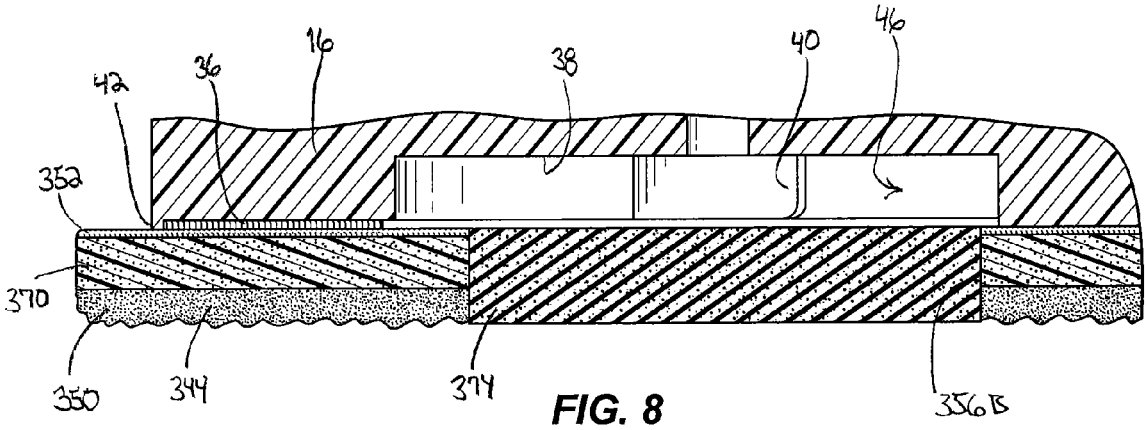
FIG. 8 is a cross-sectional view of the base of the steam surface cleaner of FIG. 1 similar to the cross-sectional view of FIG. 5, but including a cleaning pad accordingly to another embodiment of the invention.

FIG. 8 illustrates a cleaning pad 344 according to another embodiment for use with the foot 16, and the cleaning pad 344 includes features similar to the cleaning pads 44, 144, and 244 of FIGS. 1-7 and therefore only differences between the cleaning pads 44, 144, 244, and 344 will be discussed. Also, like components have been given like reference numbers in the 300 series. The cleaning pad 344 includes a patch 374 or portion of material on that is located in one or more of the apertures 356A, 356B, or 356C that is formed from a material dissimilar to the other material making up the layers 350, 352, and 370. In one embodiment, this dissimilar material of the patch 374 is more abrasive than the surrounding material of the second layer 252. Therefore, the user can apply force to the foot 16 and thereby use the abrasive properties of the patch 374 to scrub soil or other debris from the surface to be cleaned.

Figure 9:
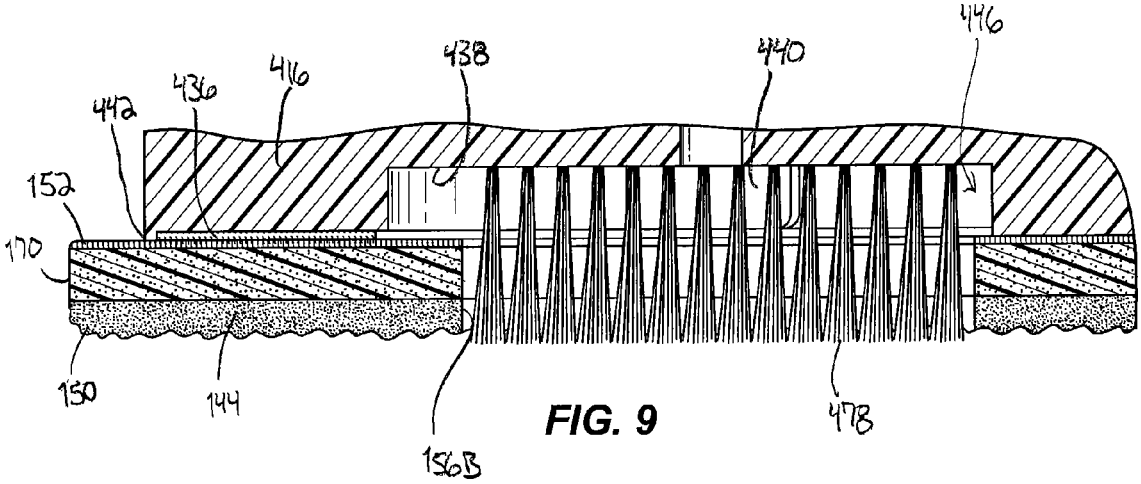
FIG. 9 is a cross-sectional view of a base according to another embodiment of the invention including the cleaning pad of FIG. 6.

FIG. 9 illustrates a foot 416 for use with a surface cleaner according to another embodiment. The foot 416 can be used with any one of the pads 44, 144, 244, or 344 described above although the foot 416 is illustrated in FIG. 9 with the pad 144 of FIG. 6. The foot 416 is similar to the foot 16 described above in regard to FIGS. 1-5 and therefore only the differences between the foot 16 and 416 will be described below and like components have been given like reference numbers in the 400 series. The foot 416 includes a plurality of bristles 478 or another course material for scrubbing the surface to be cleaned. The bristles 478 extend through one or more of the apertures 156A, 156B, and 156C such that when the pad 144 is attached to the foot 416, the bristles 478 protrude unrestrained through one or more of the apertures 156A, 156B, and 156C. The user can apply force to the foot 416 and use the abrasive properties of the bristles 478 to scrub soil or other debris from the surface to be cleaned. In an alternative embodiment, the pad 144 does not include any apertures 156A, 156B, and 156C or the apertures 156A, 156B, and 156C are positioned on the pad 144 such that none of the apertures 156A, 156B, and 156C align over or expose the bristles when the pad 144 is attached to the foot 416.

Various features and advantages of the invention are set forth in the following claims.

What is claimed is:

1. A steam surface cleaner operable to clean a surface, the surface cleaner comprising:

a supply tank configured to retain a cleaning fluid;

a base including a dispensing nozzle in fluid communication with the supply tank to dispense the cleaning fluid from the supply tank and onto the surface;

a handle configured to move the base along the surface;

a heater operable to heat the cleaning fluid to generate steam such that the cleaning fluid dispensed from the dispensing nozzle includes steam;

a cleaning pad coupled to the base for movement with the base and such that the cleaning pad is configured to directly contact the surface, the cleaning pad including an aperture that allows the cleaning fluid to flow from the dispensing nozzle, through the aperture, and onto the surface; and a plenum between the cleaning pad and the base, wherein the dispensing nozzle discharges the cleaning fluid into the plenum, and wherein the aperture is in fluid communication with the plenum to allow the cleaning fluid to flow from the plenum, through the aperture, and onto the surface.

2. The steam surface cleaner of claim 1, wherein the cleaning pad includes a first layer including a first material and a second layer including a second material different than the first material.

3. The steam surface cleaner of claim 2, wherein the first layer includes a fastener to removably couple the cleaning pad to the base.

4. The steam surface cleaner of claim 2, wherein the aperture extends through the first layer.

5. The steam surface cleaner of claim 4, wherein the aperture extends through the second layer.

6. The steam surface cleaner of claim 2, wherein the second material includes a micro-fiber cloth.

7. The steam surface cleaner of claim 2, wherein the cleaning pad includes an outer perimeter, and wherein the aperture extends through the first and the second layers within the outer perimeter.

8. The steam surface cleaner of claim 7, further comprising a third material located within the aperture and extending at least partially through the aperture.

9. The steam surface cleaner of claim 1, further comprising ribs that extend from the base to the cleaning pad to at least partially form the plenum.

10. The steam surface cleaner of claim 1, further comprising a brush including a plurality of bristles that extend through the aperture to contact the surface.

11. The steam surface cleaner of claim 1, wherein the cleaning pad includes an outer perimeter, wherein the base includes an outer perimeter, wherein the aperture is located within the outer perimeter of the cleaning pad, and wherein the outer perimeter of the cleaning pad extends past the outer perimeter of the base to provide a tab configured to allow a user to step on the tab to remove the cleaning pad from the base.

12. The steam surface cleaner of claim 1, wherein the handle is pivotally coupled to the base, and wherein the supply tank is coupled to the handle for pivotally movement with the handle with respect to the base.

* * * * *